US006131621A

United States Patent [19]

Garrard

[11] Patent Number: 6,131,621

[45] Date of Patent: Oct. 17, 2000

[54] VAPOR RECOVERY SYSTEM FOR A FUEL DISPENSER

[75] Inventor: John Edward Garrard, Leigh-On-Sea, United Kingdom

[73] Assignee: J. H. Fenner & Co., Ltd., United Kingdom

[21] Appl. No.: 09/194,746

[22] PCT Filed: Jan. 20, 1998

[86] PCT No.: PCT/GB98/00172

§ 371 Date: Dec. 2, 1998

§ 102(e) Date: Dec. 2, 1998

[87] PCT Pub. No.: WO98/31628

PCT Pub. Date: Jul. 23, 1998

[30] Foreign Application Priority Data

Jan. 21, 1997 [GB] United Kingdom ..... 9701124
Jul. 3, 1997 [GB] United Kingdom ..... 9713968

[51] Int. Cl.[7] ..... B67D 5/04; B67D 5/06

[52] U.S. Cl. ..... 141/59; 141/290; 137/861.52

[58] Field of Search ..... 141/7, 45, 59, 141/290; 73/861.52

[56] References Cited

U.S. PATENT DOCUMENTS

| | | | |
|---|---|---|---|
| 3,071,160 | 1/1963 | Weichbrod | 73/861.52 |
| 3,838,598 | 10/1974 | Tompkins | 73/861.52 |
| 4,015,473 | 4/1977 | Kleuters et al. | 73/861.52 |
| 5,040,577 | 8/1991 | Pope | 141/59 |
| 5,417,256 | 5/1995 | Hartsell, Jr. et al. | 141/7 |
| 5,763,791 | 6/1998 | Shambayati | 73/861.52 |

FOREIGN PATENT DOCUMENTS

| | | | |
|---|---|---|---|
| 4200803 A1 | 7/1993 | Germany | B67D 5/378 |
| 495 744 | 10/1970 | Switzerland | A61B 5/08 |

*Primary Examiner*—J. Casimer Jacyna
*Attorney, Agent, or Firm*—Leydig, Voit & Mayer, Ltd.

[57] ABSTRACT

A vapor recovery system for use in a fuel dispenser. The system has a vapor recovery line for collecting fuel vapor. A Fleisch tube is mounted in the recovery line and connected to a differential pressure transducer for monitoring the volumetric flow rate of fuel vapor through the recovery line. The Fleisch tube provides highly accurate flow rate measurements which are used to set the appropriate vapor recovery rate.

6 Claims, 3 Drawing Sheets

VAPOUR RETURN MANIFOLD
TOO UNDERGROUND TANKS
FUEL
GRADE 3
FUEL
GRADE 2
FUEL
GRADE 1
1
2
3
4
5
6
7
8
9
10

VAPOUR RETURN MANIFOLD
TO0 UNDERGROUND TANKS
FUEL GRADE 3
FUEL GRADE 2
FUEL GRADE 1
1
2
3
4
5
6
7
8
9
10

VAPOR RECOVERY SYSTEM FOR A FUEL DISPENSER

FIELD OF THE INVENTION

The present invention relates to a vapour recovery system for use in a fuel dispenser dispensing a volatile fuel such as petrol. More specifically the present invention relates to such a system provided with means for monitoring the fuel vapour flow rate.

BACKGROUND OF THE INVENTION

When filling the fuel tank of a vehicle with petrol vapour tends to escape from the tank filler neck to atmosphere. However, it is now recognised that petrol vapour includes benzine and that this is a carcinogenic material. Clearly, it is unacceptable to allow the uncontrolled release of dangerous materials into the environment. In order to prevent this fuel dispensers are now increasingly provided with vapour recovery systems. In the U.S.A. in particular the provision of fuel dispensers with vapour recovery systems is expected to be made mandatory.

Fuel is customarily delivered to the tank through a nozzle via a fuel hose and vapours are recovered from the immediate vicinity of the nozzle through a manifold with inlets in it which surrounds the nozzle. The manifold is connected to a vapour recovery line which conveys the vapour to the main fuel reservoir from whence the fuel was drawn or a separate underground tank. In one known vapour recovery system, the vapours and any fuel emerging from the tank being filled are drawn through the manifold into the vapour recovery line by a vapour recovery pump. Ideally a 1:1 ratio of fuel dispensed to vapour recovered must be achieved in order to ensure efficient vapour removal and to avoid pressurising the tank/reservoir to which the fuel vapour is returned. In order to ensure that this ratio is maintained the flow of recovered fuel vapour must be controlled.

In one known system described in U.S. Pat. No. 5,040,577 the volumetric flow of a vapour recovery means is controlled by a programmed microprocessor. Electrical signals are derived from sensors that are related in a known way to the volumetric flow of the fuel dispenser and are then applied to the microprocessor. The microprocessor then determines on the basis of information stored therein the parameters of an electrical signal that can be applied to the vapour recovery means in order to achieve the required vapour recovery rate. The volumetric vapour flow can be controlled by adjusting the speed of the motor driving the vapour recovery pump and/or by controlling the position of a variable valve or damper in the vapour recovery line.

Whereas the volumetric flow rate in the vapour recovery line may be set to equal that in the fuel delivery hose, there are conditions, such as differences in the temperature of the fuel in the vehicle tank and fuel from the fuel supply reservoir under which it is desirable to use a volumetric vapour flow rate that is different from the volumetric fuel flow rate. To this end it is desirable to obtain an indication of the volumetric vapour flow rate. Any differences between the measured vapour flow rate and the vapour flow rate required to match the fuel flow rate can then be compensated for adjusting the speed of the vapour recovery pump and/or the position of the variable valve or damper situated in the vapour recovery line.

In one embodiment, a sensor generates an electrical signal corresponding to the hydraulic pressure at the inlet side of the pump for the vapour recovery means. Under average conditions, the pressure will have a desired nominal value.

When it is less than this value, the nominal pressure is restored by decreasing the volumetric flow of the vapour recovery means, and when it is greater than this value, nominal pressure is restored by increasing the volumetric flow of the vapour recovery means. The microprocessor is programmed to respond to the signal representing the pressure and provide signals for controlling the volumetric flow of the vapour recovery means. This is particularly easy to do if, in accordance with this invention, the motor driving the recovery pump is of the stepping type because it is driven at a speed determined by the repetition rate of drive pulses, and this can be easily changed.

The closed loop system described hereinabove gives relatively good system accuracy and can compensate for wear in the system, but the sensors for measuring the vapour flow rate, in particular, have problems associated with them.

One known sensor for use in measuring the fuel vapour flow rate in a fuel vapour recovery line is the so-called "turbine" type. Essentially this comprises a rotary member having radially extending spokes projecting from a central hub. Each of the spokes carries a vane. The transducer is placed in the fuel vapour recovery line in such a way as to be rotated by the passage of vapour past the vanes. The speed of rotation of the rotary member determines the vapour flow rate past it.

This type of sensor is relatively inexpensive, but is not ideally suited to this type of application as it does not cope well with liquid or liquid/vapour phases which may occasionally present themselves. Moreover, it is slow to respond which can give rise to false signals during delay times.

Another known sensor for this type of application takes the form of a thermal sensor chip. As vapour passes over the surface of the chip it has the effect of cooling it. The amount of cooling is determined by the chip and is indicative of the vapour flow rate past it.

The principal disadvantage associated with this type of sensor is that it is relatively expensive. Moreover, because the chip is very delicate it is not usually placed directly in the fuel vapour recovery line, but rather in a bypass loop. In the bypass loop the sensor only measures a portion of the actual fuel vapour flow and therefore it cannot be relied upon to be completely accurate. Furthermore, this type of sensor does not work well when liquid fuel is drawn in with the vapour. Not only can the sensor output vary, but it is difficult to clear this condition.

Yet another known sensor for this type of application is a variable orifice sensor. This takes the form of a ball or float mounted within a tapered tube mounted vertically in the wall of the fuel vapour recovery line. As the flow increases, then the float will lift in the tube to allow sufficient orifice for the passage of gas. The degree of displacement is indicative of the vapour flow rate within the line.

The float movement is then sensed externally (usually by a magnet) and this is then converted into an analogue signal. Here again problems arise when slugs of liquid fuel try to pass the float. Then the float is ejected upwards to its maximum position which could damage the device.

Another sensor is the fixed orifice plate with measuring equipment at the inlet/outlet positions. This type of sensor usually has a small orifice in order to obtain reasonable values of pressures. This means the sensor is very restrictive on high flows due to its nature.

BRIEF SUMMARY OF THE INVENTION

It is an object of the present invention to provide a vapour recovery system for a fuel dispenser comprising means for accurately measuring the volumetric vapour flow rate in a vapour recovery line which obviates or at least substantially mitigates the problems associated with the known sensors referred to hereinabove.

It is another object of the present invention to provide a sensor for use in a vapour recovery system for a fuel dispenser which can survive and maintain a high level of accuracy when, during a fuel dispensing cycle, fuel enters the system together with fuel vapour.

According to the present invention there is provided a fuel dispensing system comprising:

a fuel delivery line connected at one end to a fuel reservoir and at the other end to a fuel delivery nozzle;

means for delivering fuel from the fuel reservoir to the fuel dispensing nozzle along said fuel delivery line with a variable volumetric flow;

first sensor means for determining the said volumetric fuel flow rate;

a vapour recovery line connected to an inlet manifold or skirt connected to the fuel dispensing nozzle;

vapour recovery means located in the vapour recovery line;

second sensor means for determining the volumetric vapour flow rate in the vapour recovery line; and control means responsive to outputs of the first and second sensors for controlling the vapour recovery means to ensure that the volumetric vapour flow rate in the vapour recovery line is a predetermined function of the volumetric fuel flow rate, characterised in that the second sensor means comprises a Fleisch tube in combination with a differential pressure transducer.

Fleisch tubes are already known for determining the volumetric flow rate in respirators and aqualungs, for which purpose they were originally designed. However, to the best of the applicants knowledge they have not been suggested for use in other applications, and certainly not for use in a vapour recovery system for a fuel dispenser. In this connection it must be born in mind that the environment within a respirator is much less harsh than within a fuel dispenser.

The applicants have determined that a Fleisch tube meets all the requirements for effective operation within the vapour recovery system of a fuel dispenser. Having no moving parts, it has the ability to pass fuel vapour, liquid fuel and fuel vapour liquid mixes without damage.

Essentially, a Fleisch tube comprises one or more thin stainless steel, corrugated plates which are arranged within a tubular outer casing so as to define a plurality of longitudinally extending tubes or capillaries. The tubular outer casing is adapted to be inserted into the vapour recovery line so that the tubes or capillaries are continuous therewith. A connection pipe is inserted through the wall of the outer casing into each end of one of the tubes or capillaries. As fuel vapour passes along the vapour recovery line through the Fleisch tube there is inevitably a pressure drop from one end of each tube or capillary to the other end. It is a characteristic of the construction of a Fleisch tube that this pressure drop is the same for each and every tube or capillary. This pressure drop can be detected across the two external connection pipes which are connected into one of the tubes or capillaries. The Fleisch tube ensures that a particularly accurate measure of the pressure drop across it can be obtained because the tubes or capillaries convert the otherwise turbulent vapour flow into a smooth laminar flow.

The pressure differential transducer is connected across the external connection pipes to measure the pressure differential between the inlet end of the Fleisch tube and the outlet end. This pressure differential is a known and repeatable function of the volumetric vapour flow rate in the vapour recovery line. Conveniently, the pressure differential transducer comprises a diaphragm mounted between the external connection pipes and having strain gauges mounted on the surface thereof to detect movement. This type of transducer is very sensitive and can measure accurately even very small pressure differentials across the two faces of the diaphragm.

In a preferred embodiment of the present invention the Fleisch tube comprises a thin corrugated plate having a thin flat plate covering one side to form therebetween a plurality of longitudinally extending open-ended tubes or capillaries, and the two plates are rolled up in a coil, an outer casing defining a cylindrical cavity adapted to receive the coiled-up plates, and a pair of connecting pipes, each of which is mounted in the wall of the outer casing and opens into one of the tubes or capillaries, each at a respective end thereof.

In the event that liquid fuel is drawn into the vapour recovery line the Fleisch tube has no moving parts which can be damaged and the pressure differential transducer which does have moving parts is not in the vapour recovery line as a consequence of this. It will be understood that small amounts of liquid fuel may still enter the external connection pipes thereby reducing the pressure differential across them. In order to overcome this problem control means for the fuel dispenser system of the present invention may be configured such that during and/or after each fuel dispensing operation the vapour recovery pump in the vapour recovery line continues to run and the variable valve or damper, also in the vapour recovery line, is pulsed open and closed on a self-sensing system. This has the effect of rapidly inducing full to minimum vacuum within the vapour recovery line, thereby clearing the external connection tubes and the Fleisch tube itself and restoring the pressure differential signal across these.

In a preferred embodiment of the fuel dispenser according to the present invention the control system may even be configured to automatically sense liquid fuel removal from the fuel tank into the vapour recovery line during a fuel dispensing operation and/or a build up of liquid fuel condensate within the vapour recovery line. This is indicated by any unexpected changes in the output of the pressure differential transducer. Whenever this occurs the pulsing technique described above may be employed to clear the Fleisch tube.

The response time of the Fleisch tube and pressure differential transducer combination to variations in the volumetric vapour flow rate through the vapour recovery line is particularly high because the electrical signal output from the combination does not have to compensate for any moving or rotating parts or heat transfer coefficients. Both of these problems are associated with the conventional sensor elements described hereinbefore.

Because the Fleisch tube is situated within the vapour recovery line it is able to measure the full volumetric vapour flow therein and there are no inaccuracies caused by diverting a portion of this past a sensor situated in a bypass line.

In one embodiment of the present invention two or more vapour recovery lines, each having a Fleisch tube and pressure differential transducer combination, and a variable valve or damper connected in them are connected to a single vapour recovery pump (of suitable vacuum capacity). As the Fleisch tube and transducer combination together provide an accurate indication of the vapour flow rate in each vapour recovery line the vapour recovery pump and each of the variable valves can be set to give the required vapour recovery rate for each vapour recovery line.

In a fuel dispenser according to the present invention a microprocessor may be used to compare and analyse the vapour to fuel recovery rate during each fuel dispensing operation as with the fuel dispenser described in U.S. Pat. No. 5,040,577. Not only can any error in the vapour recovery rate be accurately determined, and if required displayed, but also an out of calibration indication can be given (or advanced warning of pending problems wear, etc.).

Furthermore, by sampling the data received from the fuel dispenser sensors over a period of time an average reading for each fuel dispensing operation can be produced which would help to smooth out any transient deviations in the measured parameters caused by operator mis-use or inconsistency when operating the fuel dispenser.

BRIEF DESCRIPTION OF THE SEVERAL VIEWS OF THE DRAWINGS

Embodiments of the present invention will now be described, by way of example with reference to the accompanying drawings, in which.

DETAILED DESCRIPTION OF THE PREFERRED EMBODIMENTS

Figure 1:
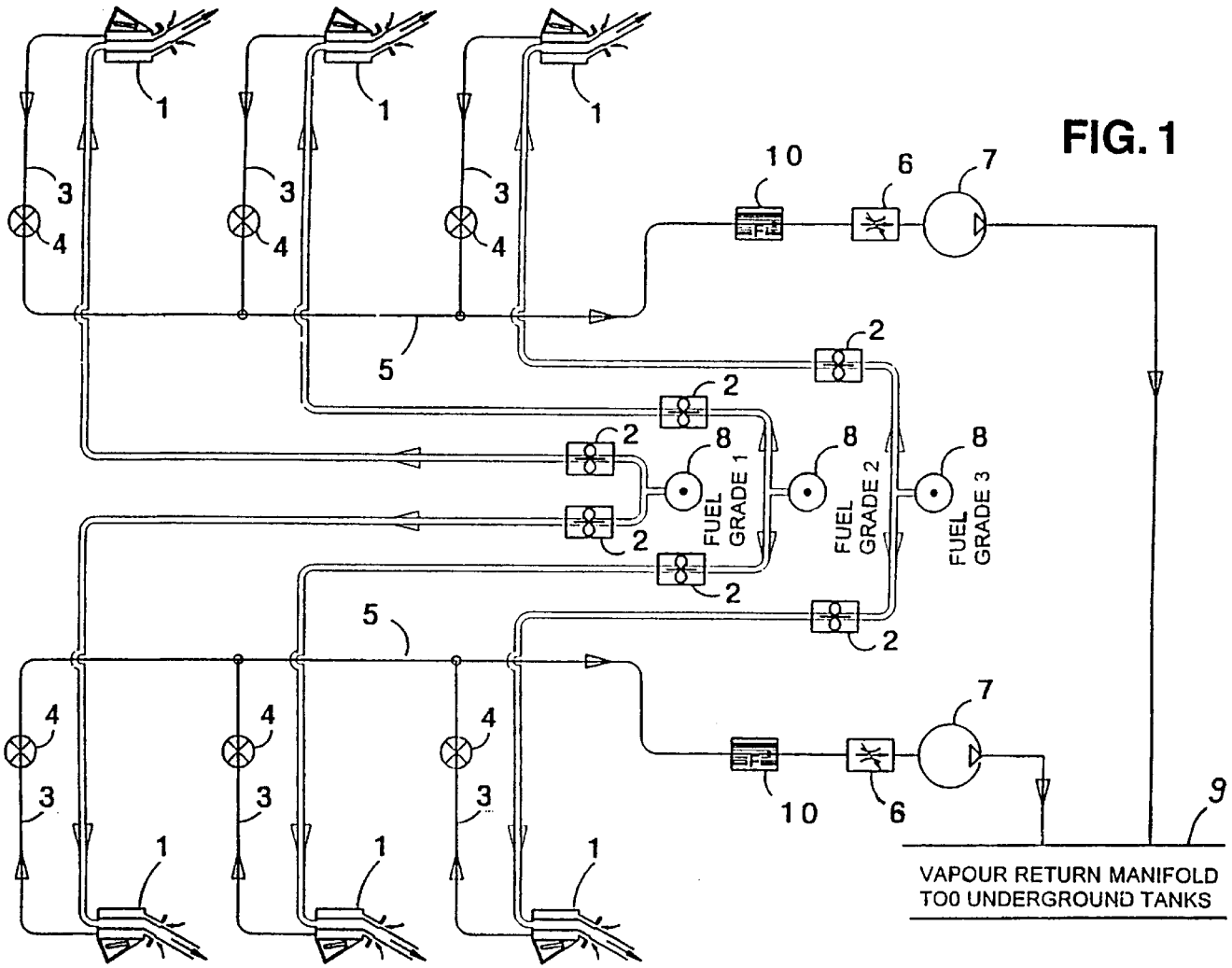
FIG. 1 shows schematically a fuel dispenser in accordance with the present invention and comprises two sets of three fuel dispensing nozzles, each of which set is connected to a respective vapour recovery pump.

Referring to FIG. 1 the fuel dispenser comprises three pairs of fuel dispensing nozzles 1, each of which pairs is connected to a respective fuel supply reservoir 8. In a typical installation each fuel supply reservoir would contain a different grade of fuel. The fuel dispensing nozzles 1 forming each pair are connected to a respective fuel supply reservoir 8, each via an appropriate pump (not shown) and a flow meter 2 which determines the volumetric fuel flow rate to the nozzle during each fuel dispensing operation. As shown, each fuel dispensing nozzle 1 is connected via a surrounding inlet manifold to a respective vapour recovery line 3. Within each vapour recovery line 3 is a simple on/off valve 4 which is opened when the nozzle associated with it is in use and closed when it is not.

The vapour recovery lines 3 are divided into two groups of three (in the drawing those in the upper half comprise one group and those in the lower half the other group) which are connected into a common line 5. This common line 5 is connected to. one of the fuel supply reservoirs, or to a separate underground storage tank, generally indicated by reference 9. Within both of the common lines 5 there is provided a variable control valve 6, a vapour recovery pump 7 and a flow sensor 10. These units operate in conventional fashion to regulate the volumetric vapour flow rate in the vapour recovery line associated with a nozzle which is in use so as to match the volumetric fuel flow rate from that nozzle. Typically, this is achieved using a microprocessor based control system after the fashion of U.S. Pat. No. 5,040,577.

Figure 2:
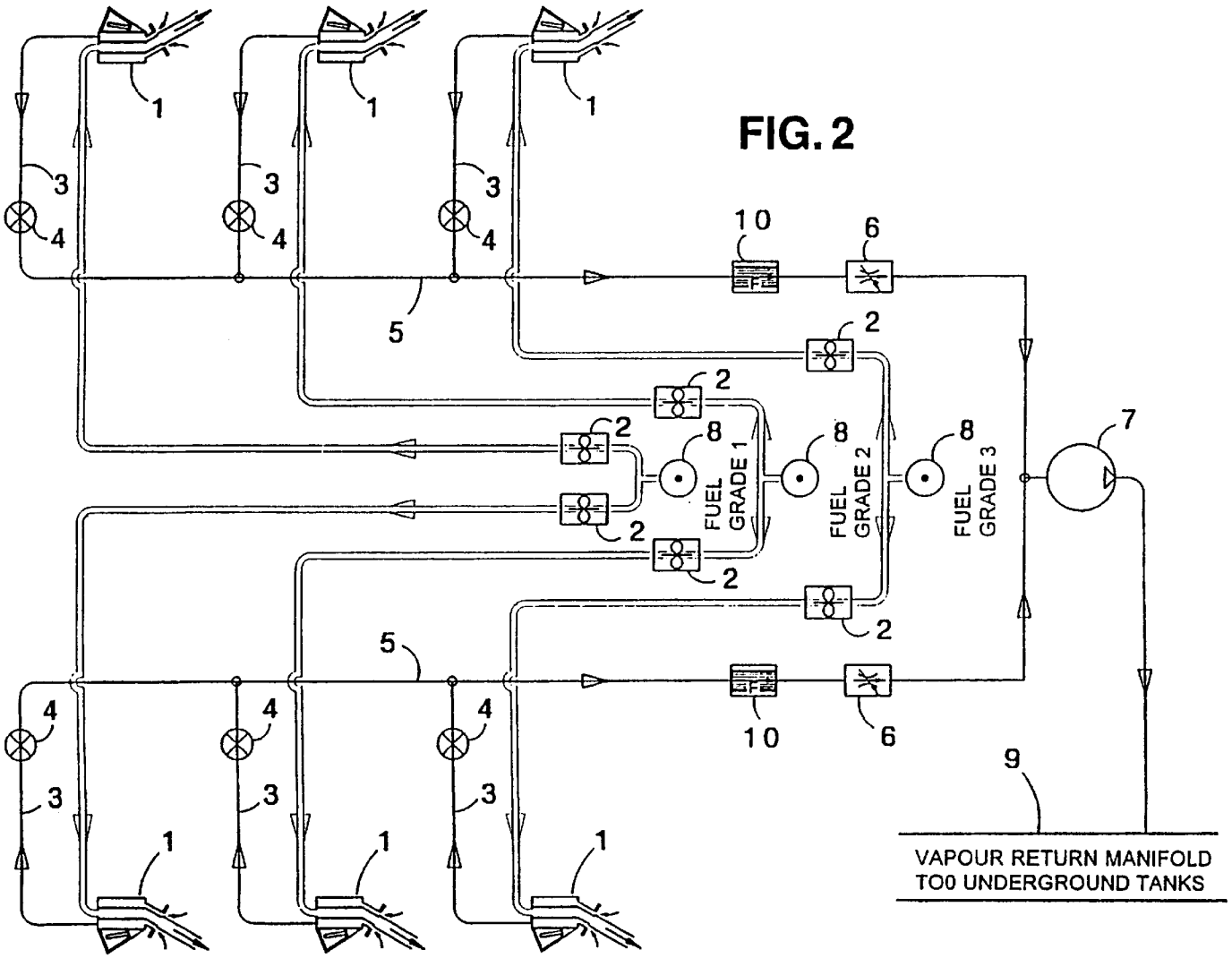
FIG. 2 shows a fuel dispenser in accordance with the present invention which is essentially identical to that of FIG. 1, except that both sets of pumps are connected to a common vapour recovery pump.

As shown in FIG. 2 the common lines 5 may be connected together after the variable control valves 6, and a single vapour recovery pump 7 used to pump fuel vapour to the underground storage tank 9.

In both of the fuel dispensers described above the flow sensors 10 comprise Fleisch tubes connected to a differential pressure transducer (not shown) the output of which is made suitable to be input to the microprocessor based control system. In each case the Fleisch tube itself is connected in the vapour recovery line. The advantages of using this type of sensor have been discussed hereinbefore.

On single hose/nozzle/pump combinations within a dispenser, it is easy to tune the system to the desired recovery legislation/specification. On a multi point system which uses many nozzles and hoses in conjunction with a single pump it is very difficult to calibrate the system at start-up because of the component variations which effect vapour flow performance.

The use of a Fleisch tube in each vapour recovery line to provide feedback to the control microprocessor ensures that the vapour recovery pump(s) 7 and the variable dampers 6 are automatically returned to match the sensed volumetric vapour flow rate giving more accurate recovery of fuel vapour than with existing systems.

On single pump applications where it may be necessary to pull vapour from either or both of two sides when it is necessary to adjust quickly the valve positions of the side(s) which is/are running in order to prevent cross talk between sides.

The Fleisch tube when fitted to any multi-point system will automatically compensate and correct for differences in nozzles, hoses, length of pipe runs, additional fittings, etc.

The Fleisch tube feedback system can also compensate for varying atmospheric conditions and compensation can also be made for system component wear such as reduced pump performance with time thus giving longer and more predictable periods between service and/or re-calibration.

Figure 4:
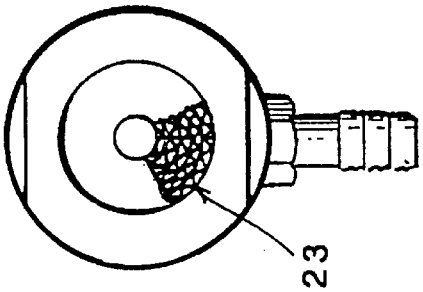
FIG. 4 shows a sectional view through the Fleisch tube shown in FIG. 3 along line A—A.
Figure 3:
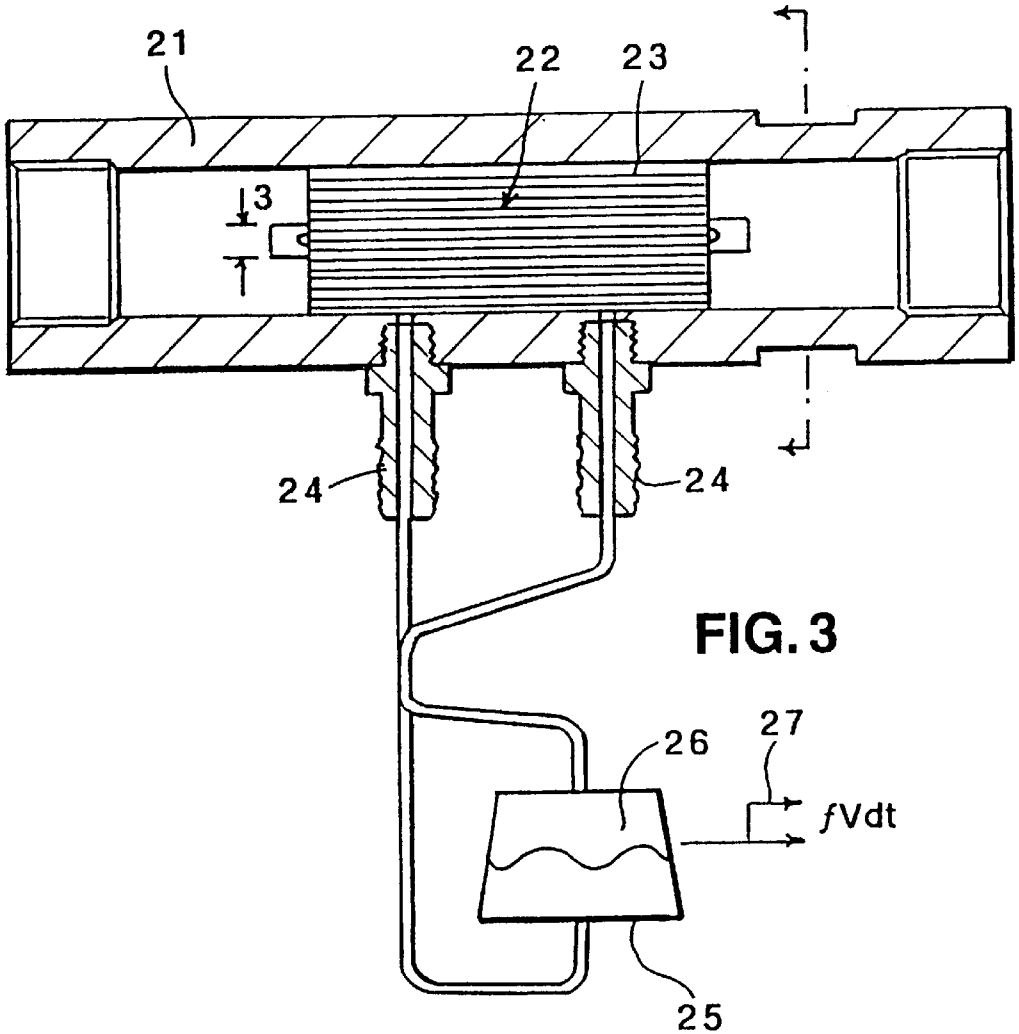
FIG. 3 shows a longitudinal section of a Fleisch tube connected to a pressure differential transducer which combination is suitable for use in the dispensers of FIGS. 1 and 2.

Referring now to FIGS. 3 and 4, the Fleisch tube comprises a cylindrical outer casing 21, the ends of which are internally screw-threaded to facilitate connection in a vapour recovery line. A resistive element 22 consisting of two sheets of thin, stainless steel, one flat and one corrugated, rolled up in a coil is provided in the outer casing 21. Together the flat and corrugated sheets define a plurality of longitudinally extending, open-ended tubes or capillaries 23. Connection pipes 24 are inserted through the wall of the outer casing 21 to connect with one or more of the tubes or capillaries 23, close to each end of said tubes or capillaries. As fuel vapour passes along the vapour recovery line through the Fleisch tube there is inevitably a pressure drop from one end of each tube or capillary 23 to the other end. It is a characteristic of the construction of a Fleisch tube that this pressure drop is the same for each and every tube or capillary. This pressure drop can be detected across the two external connection pipes 24.

A pressure differential transducer 25 is connected across the external connection pipes 24 to measure the pressure differential between the inlet end of the Fleisch tube and the outlet end. This pressure differential is a known and repeatable function of the volumetric vapour flow rate in the vapour recovery line. The pressure differential transducer 25 comprises a diaphragm 26 mounted between the external connection pipes and a strain gauge (not shown) mounted on the surface thereof to detect movement. The strain gauge provides an electrical output 27 indicative of the movement of the diaphragm and hence the pressure differential across it.

What is claimed is:

1. A fuel dispensing system comprising:

a fuel delivery line connected at one end to a fuel reservoir and at the other end to a fuel delivery nozzle;

means for delivering fuel from the fuel reservoir to the fuel dispensing nozzle along said fuel delivery line with a variable volumetric flow;

first sensor means for determining the said volumetric fuel flow rate;

a vapour recovery line connected to a vapour inlet connected to the fuel dispensing nozzle;

vapour recovery means located in the vapour recovery line;

second sensor means for determining the volumetric vapour flow rate in the vapour recovery line; and control means responsive to outputs of the first and second sensors for controlling the vapour recovery means to ensure that the volumetric vapour flow rate in the vapour recovery line is a predetermined function of the volumetric fuel flow rate, wherein:

a) the second sensor means comprises a Fleisch tube in combination with a differential pressure transducer; and b) the vapour recovery means comprises a vapour recovery pump and a variable control valve or damper situated in the vapour recovery line; and c) after each fuel dispensing operation the vapour recovery pump continues to run and the variable control valve is pulsed open and closed for a predetermined period of time to clear the Fleisch tube of any liquid fuel.

2. A fuel dispensing system according to claim 1, characterized in that the differential pressure transducer comprises a diaphragm connected across the output of the Fleisch tube and a strain gauge mounted on the diaphragm to provide an electrical signal indicative of the pressure differential across the Fleisch tube.

3. A dispensing system according to claim 2, characterized in that the Fleisch tube comprises a thin corrugated plate having a thin flat plate covering one side to form therebetween a plurality of longitudinally extending open-ended tubes or capillaries, and the two plates are rolled up in a coil, an outer casing defining a cylindrical cavity adapted to receive the coiled-up plates, and a pair of connecting pipes, each of which is mounted in the wall of the outer casing and opens into one or more of the tubes or capillaries, each adjacent to a respective end thereof.

4. A dispensing system according to claim 1, characterized in that the Fleisch tube comprises a thin corrugated plate having a thin flat plate covering one side to form therebetween a plurality of longitudinally extending open-ended tubes or capillaries, and the two plates are rolled up in a coil, an outer casing defining a cylindrical cavity adapted to receive the coiled-up plates, and a pair of connecting pipes, each of which is mounted in the wall of the outer casing and opens into one or more of the tubes or capillaries, each adjacent to a respective end thereof.

5. A dispensing system according to claim 1, characterized in that means are provided for detecting aberrations in the output of the pressure differential sensor indicative of the presence of liquid fuel in the vapour recovery line and in response to such an aberration, causing the vapour recovery pump to run while at the same time the variable control valve is pulsed open and closed to clear the Fleisch tube of such liquid fuel.

6. A dispensing system according to claim 1, wherein two or more vapour recovery lines, each having a Fleisch tube and pressure differential transducer combination, and a variable valve or damper connected in them are connected to a single vapour recovery pump (of suitable vacuum capacity).

* * * * *